US005219125A

United States Patent [19]

Rigg

[11] Patent Number: 5,219,125

[45] Date of Patent: Jun. 15, 1993

[54] YARN TRANSFER ARRANGEMENT

[75] Inventor: Gordon S. Rigg, Stockport, United Kingdom

[73] Assignee: Rieter-Scragg Limited, Macclesfield, United Kingdom

[21] Appl. No.: 775,455

[22] Filed: Oct. 15, 1991

[30] Foreign Application Priority Data

Oct. 19, 1990 [GB] United Kingdom ..... 9022848

[51] Int. Cl.[5] ..... B65H 67/048

[52] U.S. Cl. ..... 242/18 A

[58] Field of Search ..... 242/18 A, 18 PW

[56] References Cited

U.S. PATENT DOCUMENTS

| | | | |
|---|---|---|---|
| 2,306,871 | 12/1942 | Esser et al. | 242/35.6 R |
| 2,789,774 | 4/1957 | Peterson et al. | 242/18 A |
| 4,210,293 | 7/1980 | Fromaget | 242/18 A |
| 4,491,282 | 1/1985 | Hübner | 242/18 A |
| 4,598,876 | 7/1986 | Schefer | 242/18 A |
| 4,741,485 | 5/1988 | Flueli et al. | 242/18 A |
| 5,016,829 | 5/1991 | Schippers et al. | 242/18 A |
| 5,029,762 | 7/1991 | Behrens et al. | 242/18 A |

FOREIGN PATENT DOCUMENTS

| | | |
|---|---|---|
| 0286893 | 10/1988 | European Pat. Off. . |
| 406928 | 8/1966 | Switzerland . |
| 823894 | 11/1959 | United Kingdom . |
| 1308842 | 3/1973 | United Kingdom . |

*Primary Examiner*—Stanley N. Gilreath

*Attorney, Agent, or Firm*—Oblon, Spivak, McClelland, Maier & Neustadt

[57] ABSTRACT

A yarn transfer arrangement in a yarn winding machine comprises two part-circular guide plates which , when an empty tube has moved to the winding position, move from a non-operating position, spaced apart on opposed sides of the winding position of the machine by a distance greater than the diameter of a full package, to an operating position in which the plates surround the empty tube apart from an entry aperture and an exit aperture allowing yarn travel to and from the empty tube. One guide plate causes the yarn to have sufficient wrap around the empty tube that, on operation of a cutter disposed on the other guide plate adjacent the exit aperture, the cut yarn end is entrained around the empty tube between it and the other guide plate, and winding of a package on the empty tube is thereby initiated. The guide plates are then moved back to the non-operating position.

17 Claims, 3 Drawing Sheets

YARN TRANSFER ARRANGEMENT

FIELD OF THE INVENTION

This invention relates to yarn transfer arrangements, and in particular to an arrangement for transferring the winding of a textile yarn onto a full package to winding that yarn onto an empty tube, in a spindle driven winding machine.

BACKGROUND OF THE INVENTION

Conventional spindle driven winding machines are provided with one of several known arrangements for effecting such transfer. Such arrangements involve the provision of grooves or other special features on the surface of the empty tube, or teeth, slots or the like on the tube gripping chuck of the winding machine. These "yarn-catcher" features are provided so that, after the yarn travelling to the full package has been cut, the free end of the incoming yarn can be guided in the vicinity of the "yarn-catcher" feature to be gripped thereby and winding of the yarn onto the empty tube can be commenced.

However, the provision of such "yarn-catcher" features on the tubes or winder chucks adds to the cost thereof, particularly since there must be provided in addition, yarn guide means of a relatively complicated nature to guide the incoming yarn along a suitable trajectory such that it may be entrained by the "yarn-catcher" device. With such arrangements there is usually a considerable amount of waste yarn generated, and it is difficult to assess accurately the amount of yarn wound on each package.

SUMMARY OF THE INVENTION

It is the object of the present invention to provide a yarn transfer arrangement whereby the above mentioned disadvantages are avoided or minimised.

The invention provides a yarn transfer arrangement of a winding machine, comprising guide means movable, when an empty tube has moved into a winding position of the machine, from a non-operating position remote from the winding position to an operating position in which it is operable to guide a running yarn around the periphery of the empty tube, the guide means having an entry aperture through which the yarn may travel to the periphery of the empty tube and, circumferentially spaced therefrom, an exit aperture through which the yarn may travel from the periphery of the empty tube, and cutter means disposed in the path of the yarn adjacent the exit aperture.

The guide means may comprise a pair of curved plates, and the plates may have a radius of curvature substantially equal to that of the periphery of an empty tube. When in the operating position, the plates may be disposed on opposed sides of the empty tube to substantially surround its periphery, with adjacent edges of the plates spaced from each other to define the entry and exit apertures therebetween. When in the non-operating position, the plates may be disposed on opposed sides of the winding position and spaced from each other by a distance greater than the diameter of a fully wound package.

The cutter means may be in the path of the yarn from the exit aperture. The cutter means may be mounted on one of the plates at an edge thereof which defines the exit aperture when the plates are in the operating position.

The winding machine may be a spindle driven winding machine, and may comprise a turret on which two spindles are mounted. The turret may be rotatable in the machine whereby an 180° rotation of the turret causes the positions of the two spindles to be exchanged between the winding position and a doffing position. The winding machine may also comprise a bail roller disposed to contact the periphery of an empty tube when in the winding position, and movable in the machine so as to remain in contact with the periphery of a package being wound on a tube in the winding position. The winding machine may comprise control means operable when the bail roller reaches a predetermined location, corresponding with a package being fully wound, to rotate the turret to move the fully wound package from the winding position to the doffing position, and an empty tube from the doffing position to the winding position, and then to move the guide means from the non-operating position to the operating position. The control means may be operable to activate the cutter means when the guide means is in the operating position, and may also be operable a predetermined time interval after activating the cutter means, to move the guide means back from the operating position to the non-operating position.

The winding machine may also comprise traverse means and deflecting means, in which case the control means may be operable to move the deflecting means so as to disengage the yarn from the traverse means after rotating the turret but before operating the cutter, and to retract the deflecting means so as to allow re-engagement of the yarn by the traverse means after the guide means has been moved back from the operating position to the non-operating position.

BRIEF DESCRIPTION OF THE DRAWINGS

The invention will now be more fully described with reference to the accompanying drawings in which.

DESCRIPTION OF THE PREFERRED EMBODIMENTS

Figure 1:
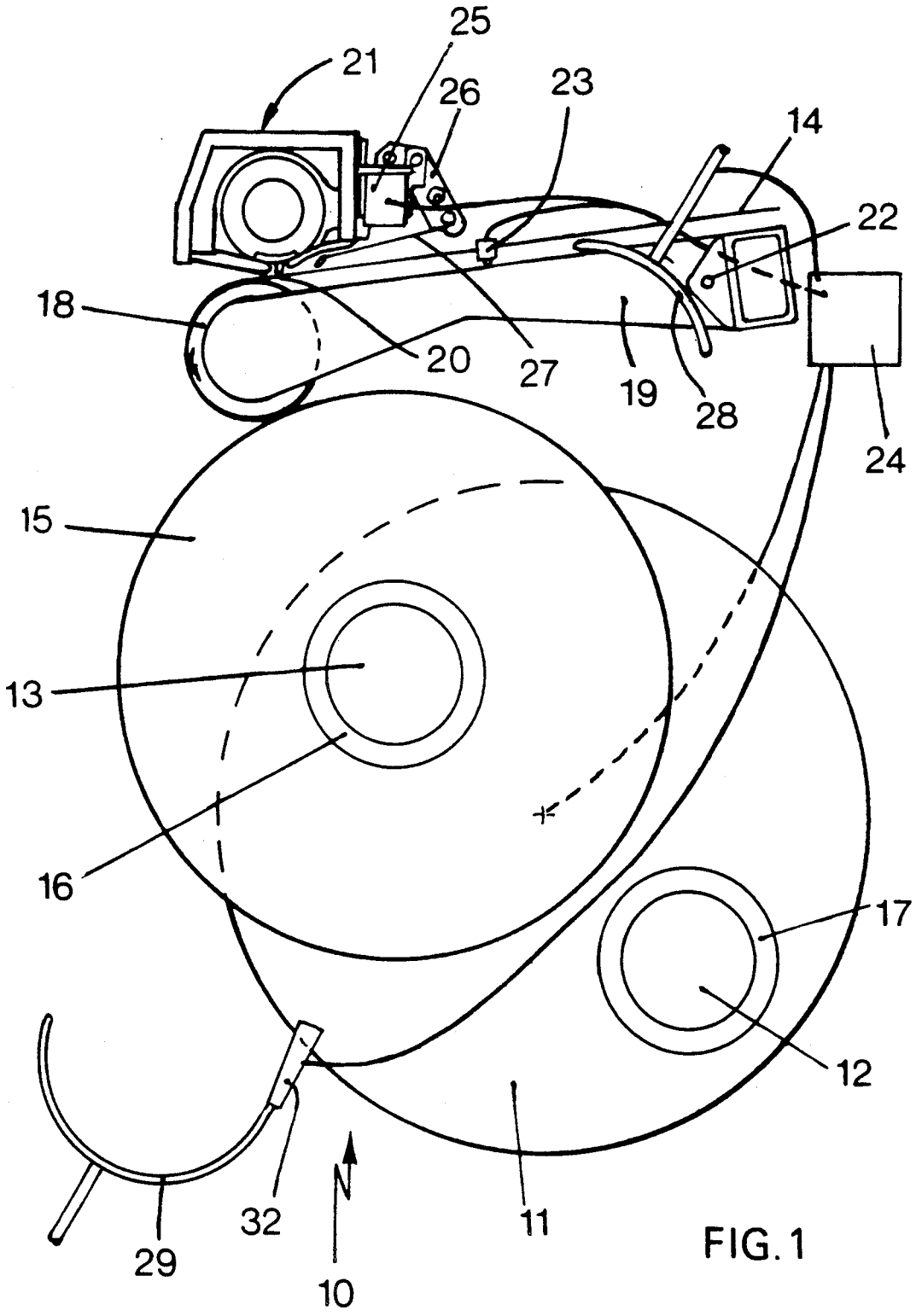
FIG. 1 is a schematic illustration of a winding machine with a package approaching the fully wound condition.

Referring now to FIG. 1, there is shown a winding machine 10 having a turret 11 mounted therein and two spindles 12, 13 mounted on the turret 11. In the situation illustrated in FIG. 1, a yarn 14 is being wound into a package 15 on a tube 16 secured on the spindle 13, which is in the winding position. An empty tube 17 is secured on the spindle 12, which is in the doffing position. The winding machine 10 has driving means (not shown) for driving the spindles 12,13 in rotation, and hence the tubes 16, 17 and any package 15 on a tube 16. The yarn 14 is laid on the surface of the tube 17 or package 15 by means of bail roller 18, which is freely rotatably mounted on an arm 19. Prior to passing around the bail roller 18, the yarn 14 is guided by a traversing yarn guide 20 of a traverse mechanism 21. The traverse mechanism 21 and the arm 19 are arranged to pivot together in the machine 10 about a pivot axis 22, so that the bail roller 18 can move upwardly as the diameter of the package 15 increases during winding, together with the arm 19 and the traverse mechanism 21.

When the package 15 is fully wound, the arm 19 contacts a sensor 23 which sends a signal to control means 24. The control means 24 initiates the transfer operation by causing rotation of the turret 11 so that the spindle 13, tube 16 and package 15 move from the winding position to the doffing position, and the spindle 12 and empty tube 17 move from the doffing position to the winding position. The control means 24 then causes activation of a pneumatic cylinder 25 of the traverse mechanism 21. The extension of cylinder 25 causes movement of a swinging arm 26 and a deflecting means 27, in the form of a lift off plate, to disengage the yarn 14 from the traverse guide 20. In these circumstances the yarn 14 is wound onto the package 15 at a single location axially thereof, which may be arranged to be a mid position or at either end of the package 15 as desired. The machine 10 is then in the condition illustrated in FIG. 2. In this condition the bail roller 18 is in contact with and is driven by the empty tube 17 and the yarn 14 travels a small distance around the periphery of the empty tube 17 before passing to the package 15. However, such contact between the yarn 14 and the tube 17 would be insufficient to entrain the yarn 14 to be wound onto the tube 17 if the yarn 14 were to be cut in the region between the empty tube 17 and the package 15.

Figure 2:
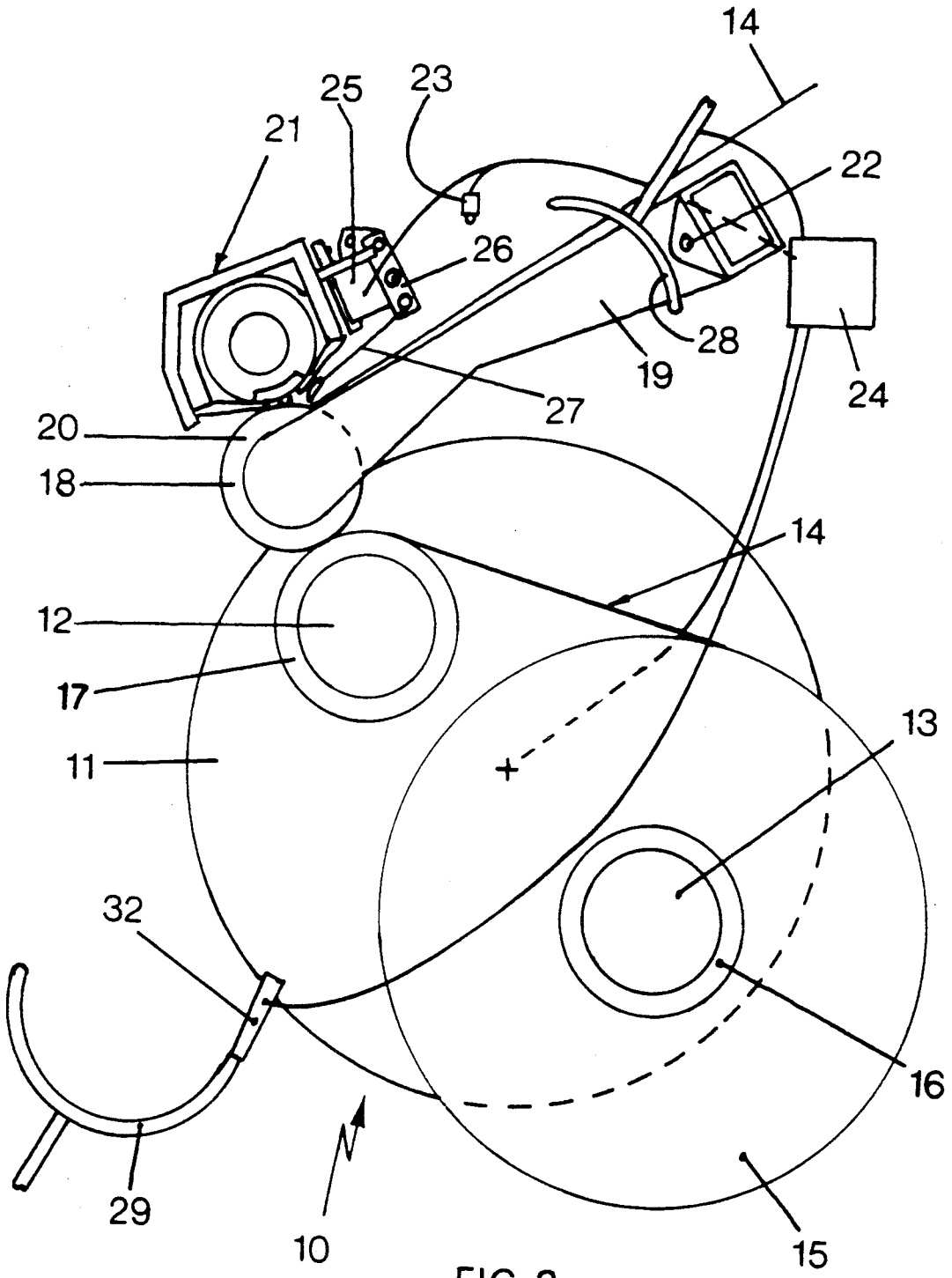
FIG. 2 is a schematic illustration of the winding machine of FIG. 1 with the full package having been moved to the doffing position.
Figure 3:
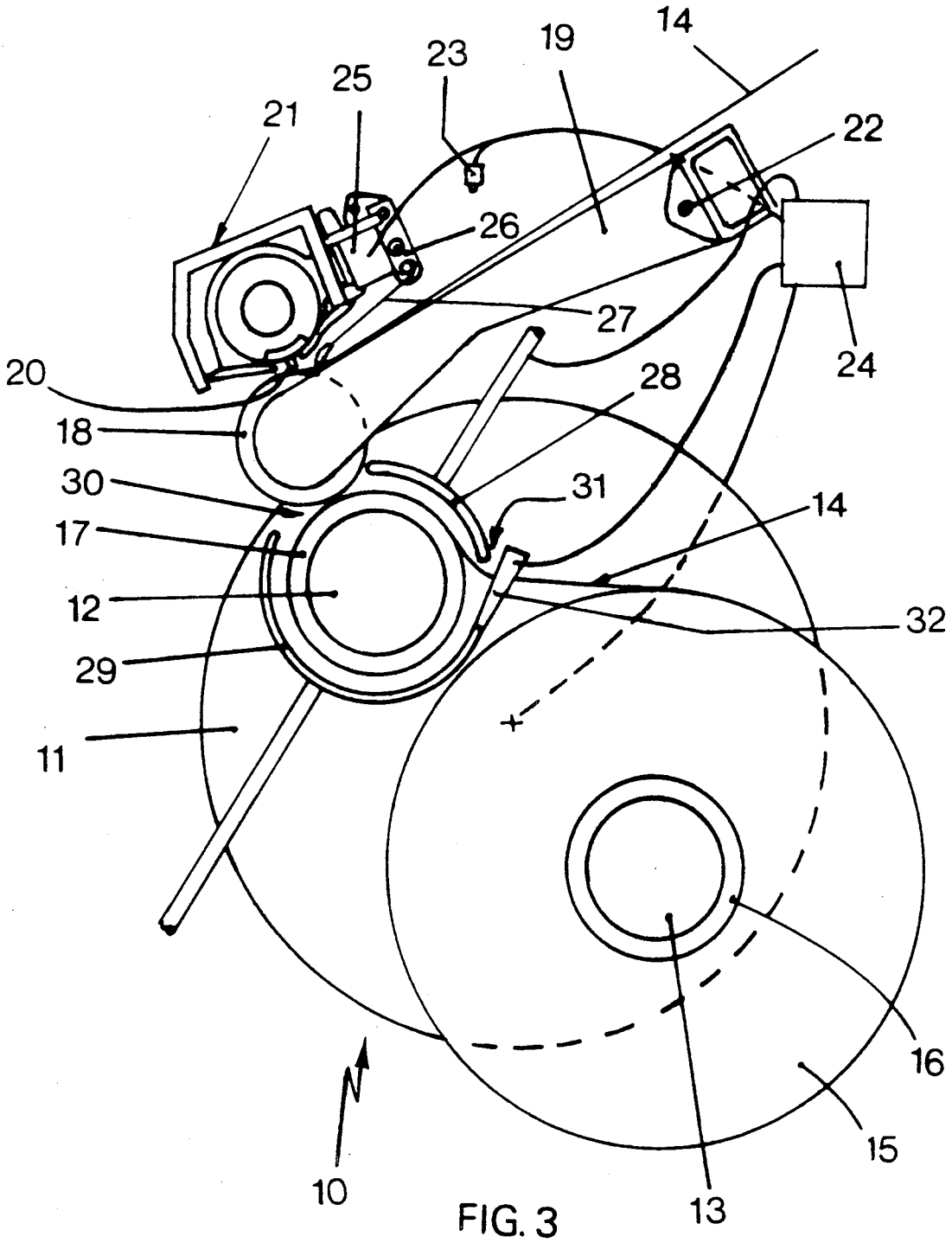
FIG. 3 is a schematic illustration of the winding machine of FIGS. 1 and 2 with the guide means in its operative position.

At this juncture, the control means 24 initiates movement of upper guide means 28 and lower guide means 29 from a non-operating position as shown in FIGS. 1 and 2, to an operating position as shown in FIG. 3. In the non-operating position shown in FIGS. 1 and 2, the guide means 28,29 are disposed spaced apart on opposed sides of the winding position by a distance greater than the diameter of a fully wound package 15, and sufficient to enable rotation of the turret 11 without contact between the package 15 and upper guide 28, or tube 17 and lower guide 29.

In the operating position shown in FIG. 3, the upper guide 28 and the lower guide 29 are disposed so as to substantially surround the periphery of the empty tube 17, with only a small clearance between the guides 28, 29 and the tube 17. The adjacent edges of the guides 28, 29 define an entry aperture 30 for the yarn 14 to pass from the bail roller 18 to the tube 17, and an exit aperture 31, for the yarn 14 to pass from the tube 17 to the package 15. A yarn cutter 32 is mounted on the lower guide 29 adjacent the edge thereof which defines the exit aperture 31 so that the yarn 14 is caused to pass through the cutter 32 as it leaves the exit aperture 31. The control means 24 then activates the cutter 32.

The package 15 is thereby detached from the supply of yarn 14, so that the spindle 13 can be stopped and the package 15 doffed therefrom. A new empty tube can then be placed on the spindle 13 and the drive thereto recommenced.

It will noted that the upper guide 28 deflects the yarn 14 further around the periphery of the empty tube 17 than was the case previously as illustrated in FIG. 2. When the yarn 14 is cut by the cutter 32, the free end drops between the tube 17 and the lower guide 29 so as to be carried around the periphery of the tube 17. When the free end of the yarn 14 reaches the region of the entry aperture 30 it is gripped in the nip between the bail roller 18 and the tube 17 so that a second lap of yarn 14 is formed on the tube 17. Since the yarn 14 is out of contact with the traverse guide 20, the incoming yarn 14 tends to lie on top of and trap previous laps of yarn 14 wound on the tube 17, so that after a very few laps the yarn 14 is securely held onto the tube 17. The control means 24 then causes the guide means 28, 29 to retract to the non-operating position, and the pneumatic cylinder 25 to retract also so that the traverse guide 20 again engages the yarn 14.

Winding of a package on the tube 17 then proceeds normally until the condition illustrated in FIG. 1 is reached, whereupon the transfer operation is repeated.

By means of the invention manipulation of the moving yarn is minimised. There is no waste yarn produced on transfer and accurately metered lengths on each package are possible. Standard tubes without surface grooves or special "yarn-catching" features can be used.

Alternative embodiments of transfer arrangement in accordance with the invention will be readily apparent to persons skilled in the art. For example the arrangement may be applied to a swinging arm winding machine instead of a rotating turret type of machine. The initiation of the transfer operation may be by means of a timing or yarn length measuring device, or package size or weight sensor, instead of an arm position sensor as described herein. Movement of the guide means may be by means of linear motors, hydraulic or pneumatic means as desired. As a further alternative, the bail roller and traverse mechanism may move linearly towards and away from the winding position instead of being mounted for pivotal movement as described herein. Similarly the upper and/or lower guide means may be mounted for pivotal movement between their non-operating and operating positions, instead of performing linear movements as shown in the Figures.

What is claimed is:

1. A yarn transfer arrangement of a winding machine having a winding position, comprising guide means movable, when an empty tube having a periphery has moved into the winding position, from a non-operating position remote from the winding position to an operating position in which it is operable to guide a running yarn around the periphery of the empty tube, the guide means when in the operating position having an entry aperture through which the yarn may travel to the periphery of the empty tube and, circumferentially spaced therefrom, an exit aperture through which the yarn may travel from the periphery of the empty tube and a yarn cutter disposed in the path of the yarn adjacent the exit aperture and operable to cut the yarn when the guide means has moved to the operating position.

2. A yarn transfer arrangement according to claim 1, wherein the yarn cutter is disposed in the path of the yarn from the exit aperture.

3. A yarn transfer arrangement according to claim 1, wherein the guide means comprises a pair of curved plates.

4. A yarn transfer arrangement according to claim 3, wherein the plates and the periphery of an empty tube each have a radius of curvature which is substantially equal to that of the other.

5. A yarn transfer arrangement according to claim 3, wherein the empty tube when in the winding position has opposed sides and the plates, when the guide means is in the operating position, are disposed on the opposed sides of the empty tube in the winding position to substantially surround its periphery, with the plates having adjacent edges spaced from each other to define the entry and exit apertures therebetween.

6. A yarn transfer arrangement according to claim 3, wherein a fully wound package has a predetermined diameter and the plates, when the guide means is in the non-operating position, are disposed on opposed sides of the fully wound package when in the winding position and spaced from each other by a distance greater than the diameter of the fully wound package.

7. A yarn transfer arrangement according to claim 3, wherein one of the plates has an edge which defines the exit aperture when the guide means is in the operating position, and the yarn cutter is mounted on that plate at that edge.

8. A winding machine having a yarn transfer arrangement according to claim 1, wherein the winding machine is a spindle driven winding machine.

9. A winding machine according to claim 8, comprising a turret and two spindles which are mounted on the turret.

10. A winding machine according to claim 9 having a doffing position, wherein the turret is rotatable in the machine whereby an 180° rotation of the turret causes the positions of the two spindles to be exchanged between the winding position and the doffing position.

11. A winding machine according to claim 10, comprising a bail roller disposed to contact the periphery of an empty tube when in the winding position, and movable in the machine so as to remain in contact with the periphery of a package being wound on a tube in the winding position.

12. A winding machine according to claim 11, comprising control means operable when the bail roller reaches a predetermined location, corresponding with a package being fully wound, to rotate the turret to move the fully wound package from the winding position to the doffing position, and an empty tube from the doffing position to the winding position, and then to move the guide means from the non-operating position to the operating position.

13. A winding machine according to claim 12, wherein the control means is operable to activate the yarn cutter when the guide means is in the operating position.

14. A winding machine according to claim 13, wherein the control means is operable, a predetermined time interval after activating the cutter means, to move the guide means back from the operating position to the non-operating position.

15. A winding machine according to claim 14, comprising a traverse mechanism operable to guide the yarn to the tube and deflecting means movable to disengage the yarn from the traverse mechanism.

16. A winding machine according to claim 15, wherein the control means is operable to move the deflecting means so as to disengage the yarn from the traverse mechanism after rotating the turret but before operating the yarn cutter, and to retract the deflecting means so as to allow re-engagement of the yarn by the traverse mechanism after the guide means has been moved back from the operating position to the non-operating position.

17. A winding machine according to claim 15 comprising an arm, wherein the bail roller and the traverse mechanism are both mounted on the arm, which is pivotally mounted in the machine.

* * * * *